US010481525B1

(12) United States Patent
Robles Flores et al.

(10) Patent No.: US 10,481,525 B1
(45) Date of Patent: Nov. 19, 2019

(54) DEVELOPMENT DEVICE MANIFOLD SEAL

(71) Applicant: Xerox Corporation, Norwalk, CT (US)

(72) Inventors: Eliud Robles Flores, Rochester, NY (US); Douglas A. Gutberlet, Ontario, NY (US); Michael Grew, Fairport, NY (US); Charles D. Deichmiller, Sodus Point, NY (US); Terry L. Dreier, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/964,104

(22) Filed: Apr. 27, 2018

(51) Int. Cl.
*G03G 15/08* (2006.01)
*G03G 21/20* (2006.01)

(52) U.S. Cl.
CPC ..... *G03G 15/0898* (2013.01); *G03G 21/206* (2013.01); *G03G 2221/1645* (2013.01)

(58) Field of Classification Search
CPC ..... G03G 15/0898; G03G 2221/1648; G03G 2221/1645
See application file for complete search history.

(56) References Cited

U.S. PATENT DOCUMENTS 3,872,826 A 3/1975 Hanson
5,315,354 A 5/1994 Mordenga
5,356,473 A 10/1994 Fromm
5,387,967 A 2/1995 Brewington et al.
5,697,018 A 12/1997 Thomas et al.
5,742,876 A 4/1998 Bogoshian
5,805,958 A 9/1998 Fisk
5,983,053 A 11/1999 Mordenga et al.
6,181,896 B1 1/2001 Zirilli et al.
8,831,465 B2 * 9/2014 Yamane ..... G03G 15/0898 399/92
9,804,532 B2 * 10/2017 Goda ..... G03G 15/0898

FOREIGN PATENT DOCUMENTS

JP 2012003169 A * 1/2012
JP 2013225049 A * 10/2013

* cited by examiner

*Primary Examiner* — Clayton E. LaBalle
*Assistant Examiner* — Leon W Rhodes, Jr.
(74) *Attorney, Agent, or Firm* — Gibb & Riley, LLC

(57) ABSTRACT

A development device includes components such as a housing, a magnetic roll in the housing that moves marking material in the housing, a donor roll in the housing that is positioned to receive the marking material from the magnetic roll, a manifold in the housing, etc. The manifold has a manifold opening positioned to create airflow from the surface of the donor roll. Further, such structures include a seal over the manifold opening. The seal is a component that has a planar linear surface with seal openings that are aligned with the manifold opening. The edge of the housing adjacent the manifold opening is a first distance from the magnetic roll and the edge of the seal is a second, closer distance from the magnetic roll.

20 Claims, 6 Drawing Sheets

DEVELOPMENT DEVICE MANIFOLD SEAL

BACKGROUND

Systems and methods herein generally relate to printers and more particularly to development devices used within electrostatic printing engines of printers.

Electrostatic printers apply a charged marking material (often as a dry powder capable of carrying a charge, such as toner, etc.) to print media to perform printing on the print media. Such printers use development devices which transfer the marking material to a photoreceptor that has a charged pattern, which in turn transfers the marking material to the print media in the pattern of the charge. Once the marking material is on the print media various devices are utilized to permanently fuse the marking material to the print media.

Sometimes defects occur during printing, which can result in unintended or inconsistent marks (artifacts) being printed on the page. For example, undesirable streaks may be formed on the print media where none were intended. The causes of such artifacts may be difficult to identify.

SUMMARY

Devices herein can comprise a printer, a development device, a seal, etc. In one example, a printer herein includes (among other components) a media supply, and a printing engine positioned to receive print media from the media supply. The printing engine adds markings to the print media using a development device, and such a development device includes components such as a housing, one or more magnetic rolls in the housing that move marking material in the housing, one or more donor rolls in the housing that is positioned to receive the marking material from the magnetic roll, a manifold in the housing, etc.

The development device includes an airflow device drawing air through passages of the manifold, and the manifold has at least one manifold opening positioned to create airflow from the surface of the donor rolls. Further, such structures include a seal over the manifold opening. The manifold opening is formed by a space between parallel surfaces of the housing. The seal contacts such parallel surfaces to cover the manifold opening.

The seal is a component that has a planar linear surface with seal openings that are aligned with the manifold opening. The manifold opening is a slot and the seal openings are oval or round. The planar linear surface of the seal has dimensions to fully cover all of the manifold opening. The seal openings are periodic and can be positioned at equal intervals along the planar linear surface. Also, the combined area of all the seal openings is less than the area of the manifold opening, increasing airflow rates and making airflow more consistent. The edge of the housing adjacent the manifold opening is a first distance from the magnetic roll, and the edge of the seal is a second, closer distance from the magnetic roll. Therefore, the seal provides a smaller and more consistent gap with the magnetic roll than does the edge of the housing.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1A:
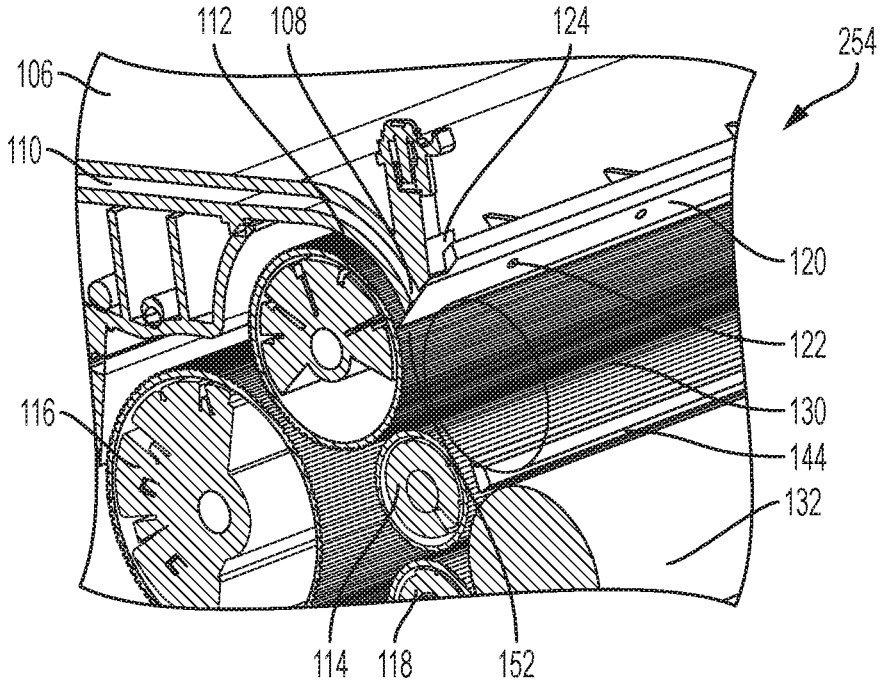
FIG. 1A is a perspective view diagram illustrating development devices herein.

As mentioned above, defects can occur during printing, which can result in unintended or inconsistent marks (artifacts) being printed on the page. Some of these artifacts are commonly referred to as pencil lines streaks (PLS), thin lines, fine line streaks (FLS), foxfires, thin streaks, etc. Such fine lines streak artifacts are best explained as "very thin streaks" that can be the result of beads (e.g., clumps of toner) escaping the magnetic ("mag") rolls and flying into the donor roll, or above the area the donor roll. These beads, once on the donor roll, can get carried and become stuck temporarily under adjacent wires.

Such stuck beads can trigger streaks in different ways. For example, the beads can "plow" through the toner layer on the donor roll, leading to an increased localized toner cloud which leaves a dark streak. In other examples, the beads can "skim" on top of the toner layer leading to a decreased localized toner cloud, which leaves a light streak. These streaks, as thin as they are, are a significant issue in the field.

In order to address such issues, the devices herein provide a bead blocker and airflow combination ("combo") manifold (CM) seal. This seal is both a bead blocker and airflow uniformity device, all in one structure. The blocker portion of this combo device prevents beads from escaping the mag area, and also makes the system robust against manifold bow (irregularities in the shape of the manifold). The airflow portion of this combo device also makes the inboard-outboard (IB-OB) air profile uniform, minimizing IB-OB discontinuities that can cause concentrated bead build up.

As shown in the accompanying drawings, devices herein can comprise a printer 204 (FIG. 3, discussed below) or individual components thereof, such as a development device 254 (FIG. 6, discussed below) or seal 120 (FIGS. 2A-2E, discussed below) of such a development device 254. In one example, the printer 204 herein includes (among other components) a media supply 230, and a printing engine 240 positioned to receive print media from the media supply 230. The printing engine 240 adds markings to the print media using the development device 254.

Figure 1B:
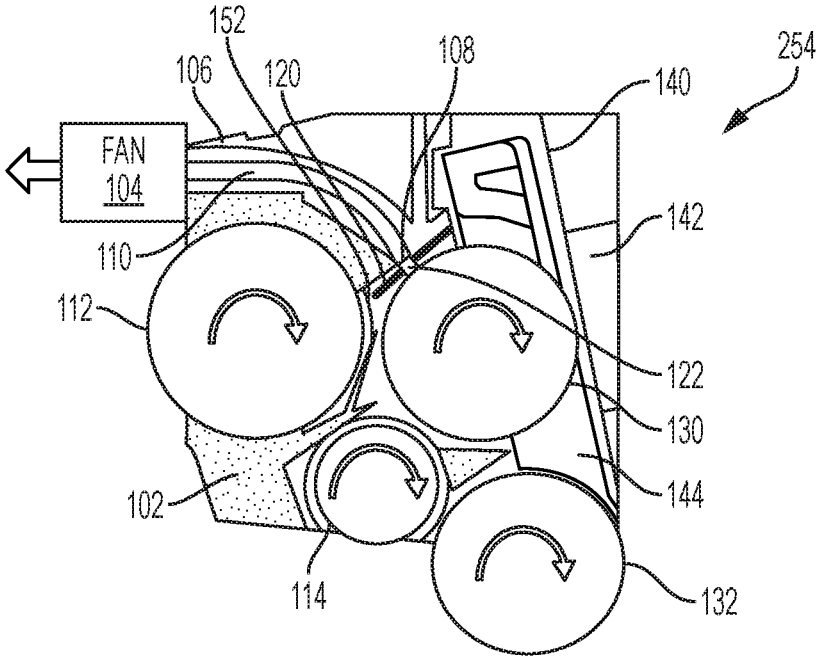
FIG. 1B is a perspective view diagram illustrating development devices herein.

FIG. 1A illustrates a portion of such a development device 254 in perspective view, and FIG. 1B illustrates the same structure in cross-section. As shown in FIGS. 1A-1B, the development device 254 includes components such as a housing 106, one or more magnetic rolls 112, 114, 116, 118 in the housing 106 that magnetically attract the charged marking material 102 and move the marking material 102 in the housing 106, upper and lower donor rolls 130, 132 in the housing 106 that are positioned to receive the marking material 102 from the magnetic rolls 112, 114, 116, 118, a divider 144 between the donor rolls 130, 132, a manifold 110 in the housing 106, etc. Note that, in FIG. 1A, the upper donor roll 130 is transparent to allow other features to be more easily seen. As shown in FIG. 1B, the development device 254 includes an airflow device (e.g., fan 104) drawing air through the manifold 110.

As shown in FIGS. 1A-1B, the manifold 110 has a manifold opening 108 positioned to create airflow from the surface of the donor rolls 130, 132. Further, such structures include a seal 120 over the manifold opening 108. The manifold opening 108 is formed by a space (channel, tunnel, etc.) between parallel surfaces in the housing 106. The seal 120 contacts such parallel surfaces to cover the manifold opening 108. The seal includes tabs 124 which help in installation/mounting of the seal.

Marking material 102 is shown within the interior of the housing 106 in FIG. 1B using small dots, and the marking material 102 can be any dry powder capable of carrying a charge, such as toner, etc. As shown in FIG. 1B, the marking material 102 is transported by rotation of the magnetic rolls (e.g., 112) but the seal 120 blocks any beads from remaining on the magnetic roll 112 as the magnetic roll 112 rotates by the seal 120. Thus, as shown in FIG. 1B, only a thin (potentially as thin as a 1-5 layers of toner particles), consistent, uniform thickness layer of toner 102 remains on the outer surface of the magnetic roll 112 after the outer surface rotates past the seal 120. Specifically, the seal 120 creates a highly controllable gap 152 with the magnetic roll 112 through which a controlled amount of marking material 102 is allowed to pass (and thereby remain on the outer surface of the magnetic roll 112).

The gap 152 is established by the size of the seal 120, as well as the location of the seal relative to the magnetic roll 112, both of which are easily controlled by manufacture and installation of the seal 120. In contrast, the shape and position of the surfaces of the housing 106 that form the manifold 110 are not as easily controlled.

Therefore, because of the limited amount of space within the gap 152 created by the seal 120, only a thin, uniform layer of toner 102 remains on the outer surface of the magnetic roll 112 at the location where the magnetic roll 112 transfers toner 102 to the upper donor roll 130 (note that the magnetic roll 112 transfers toner 102 to the upper donor roll 130 at the location where the two are closest to one another). Thus, FIG. 1B illustrates the "blocking" function performed by the seal 120, where the seal 120 blocks any beads from reaching the upper donor roll 130.

FIG. 1B also illustrates an intermediate transfer surface 140 (e.g., photoreceptor belt or drum) onto which the donor rolls 130, 132 transfer the marking material 102, and a bias device that uses electrical charge to draw the marking material 102 from the donor rolls 130, 132 to the intermediate transfer surface 140.

Figure 2A:
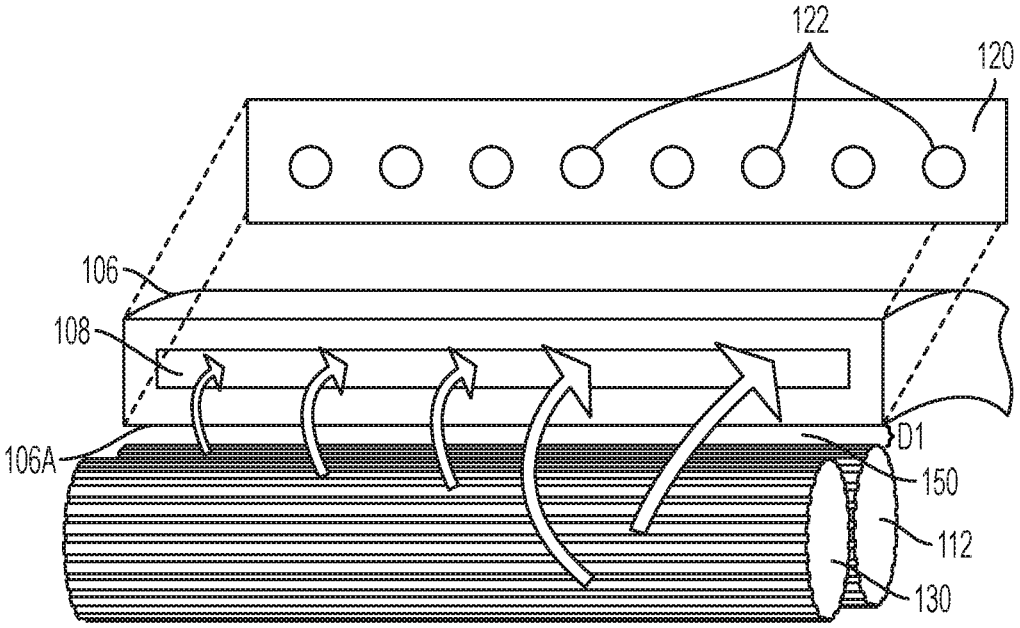
FIGS. 2A-2E are perspective view diagrams illustrating seals herein.
Figure 2B:
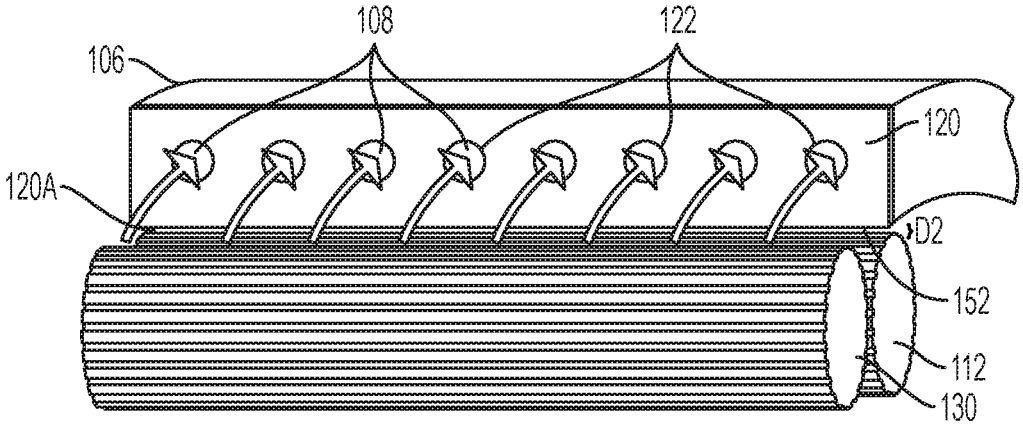
Figure 2C:
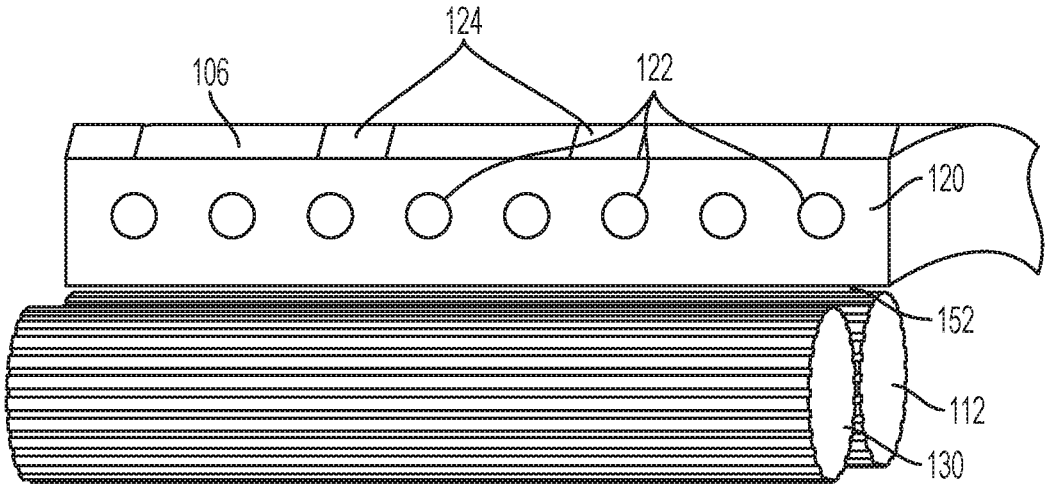

FIGS. 2A-2C illustrate the seal 120 and manifold opening 108 in greater detail. As shown in the drawings, the seal 120 is a flat, rectangular component that has two opposing planar linear surfaces (e.g., front and back) with seal openings 122 extending completely through the flat rectangular component (e.g., from the front to the back).

As shown in FIG. 2A, the seal 120 is mounted on the flat surface of the housing 106 that forms the periphery of the manifold opening 108, and FIG. 2B shows the same structure as shown in FIG. 2A, with the seal 120 mounted over the manifold opening 108, a portion of which can be seen through the seal openings in FIG. 2B. Note that the seal openings 122 are aligned with the manifold opening 108, and that the manifold opening 108 is a rectangular slot, and the seal openings 122 are oval or round. The perimeter of the planar linear surface of the seal 120 has dimensions large enough to fully cover all of the manifold opening 108.

As shown in FIGS. 2A-2B, the bottom edge 106A of the housing 106 is a first distance D1 from the magnetic roll 112 and the bottom edge 120A of the seal 120 is a second, closer (smaller) distance D1 from the magnetic roll 112. More precisely, the bottom edge 106A of the housing 106 is the edge of the housing 106 that is between the manifold opening 108 and the magnetic roll 112, and the bottom edge 120A of the seal 120 is the edge of the seal 120 that is closest to the magnetic roll 112.

The bottom edge 106A of the housing 106 may not be a precisely straight edge because the bottom edge 106A of the housing 106 can be warped when it is produced, or can become warped over time with usage. Such warping of the bottom edge 106A of the housing 106 can allow undesirable beads to pass, or can remove too much toner 102 from the surface of the magnetic roll 112, both of which will cause printing defects.

In contrast, the bottom edge 120A of the seal 120 is easily manufactured as a highly precise straight edge (through cutting, mold formation, die extrusion, etc.) and does not exhibit the warping that the bottom edge 106A of the housing 106 can. Further, while the seal 120 can be formed from any useful material (metal, alloys, plastics, rubbers, wood, ceramics, organic materials, etc) the material selection for the seal 120 is one that allows the seal 120 to be formed with a very straight bottom edge 120A that will not warp or deform within the operating environment of the development device 254. Thus, the material for the seal 120 is selected to not change shape, size, flexibility, sharpness, etc., in the temperature, pressure, light exposure conditions, vibration conditions, etc., that are expected to be experienced in the development device 254 when and after printing is performed. Therefore, the seal 120 provides a more consistent and more controllable bead blocker when compared to the bottom edge 106A of the housing 106. In other words, the seal 120 provides a smaller and more consistent gap 152 with the magnetic roll 112 than does the edge 106A of the housing 106, and will continue to do so during and after printing.

Additionally, as shown in FIG. 2A, because the manifold opening 108 is a slot that can be approximately (e.g., within 5%, 10%, 20%) as long as the magnetic roll 112, the airflow into the slot (represented by block arrows in FIG. 2A) will be irregular because of the various vortices created by the shape of the slot 108. Also, often one end of the manifold opening 108 draws more air relative to the other end (e.g., the inboard end may, for example, draw in more air relative to the outboard end). Such irregularities and inconsistencies of the airflow reduce the bead and debris scavenging efficiency of the manifold opening 108.

In contrast, because the combined area of all the seal openings 122 is less than the area of the manifold opening 108, and because the seal openings 122 are periodic and can be positioned at equal intervals along the planar linear surface, the rate of airflow into the seal openings 122 is higher and the airflow into the seal openings is more uniform relative to the airflow into the rectangular manifold opening 108 (as shown in FIG. 2B by using different block arrows from those shown in FIG. 2A). For example, the smaller, rounded, evenly spaced seal openings 122 increase airflow rate and decrease turbulence relative to the rectangular slot of the manifold opening 108.

Note that the seal 120 can be permanently connected to the flat surface of the housing 106 surrounding the manifold opening 108 by mechanical connectors (screws, rivets, bolts, pins, clips, etc.) which are generally shown as element 124 in FIGS. 1A and 2C. Additionally, or alternatively, the seal 120 can be permanently connected to the flat surface of the housing 106 surrounding the manifold opening 108 by adhesives, welds, pressure bonding, etc.

One feature herein is that the attachment mechanism 124 that connects the seal 120 to the flat surface of the housing 106 is one that consistently positions the bottom edge 120A of the seal 120 at the desired distance D2 from the surface of the magnetic roll 112. This is accomplished by the shape and location of the mechanical connections 124, or through the use of a mounting frame or jig. Further, the seal 120 is manufactured to have a precisely straight bottom edge 120A to keep the gap 152 between the magnetic roll 112 and the bottom edge 120A consistent along the full length of the magnetic roll 112.

Figure 2D:
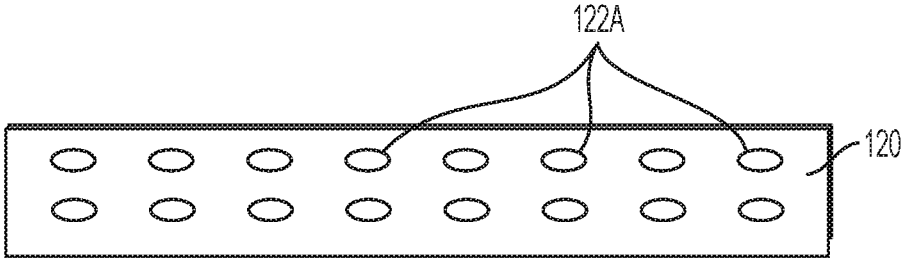
Figure 2E:
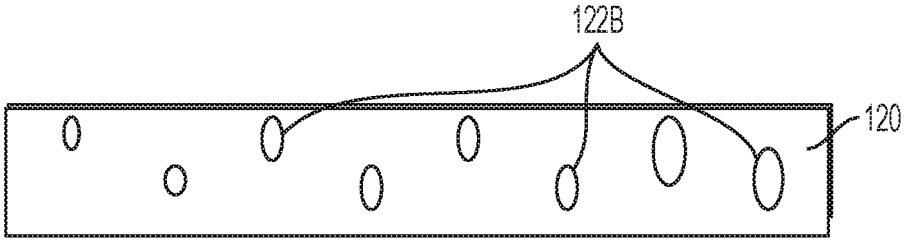

While the seal openings 122 are shown in FIGS. 2A-2C as being round and aligned, in other implementations, the seal openings 122A can be oval and aligned in parallel rows (FIG. 2D). In additional structures, as shown in FIG. 2E, the oval seal openings 122B can be oriented differently (e.g., with the longer dimension (longer diameter) being at different angles relative to the edges of the seal 120). As also shown in FIG. 2E, and the seal openings 122B may not be (avoid being) aligned in rows. FIG. 2E further illustrates that the seal openings 122B can be different sizes. Therefore, FIGS. 2D-2E illustrate that the size, location, arrangement, etc., of the seal openings 122A-122B can be tuned to provide the desired airflow based on how other adjacent structures (e.g., magnetic rolls, housing elements, airflow devices, manifold shape, etc.) affect airflow. In other words, the size, location, arrangement, etc., of the seal openings 122A-122B can be changed to compensate for the undesirable airflow affects caused by other components of the development device 254.

Figure 3:
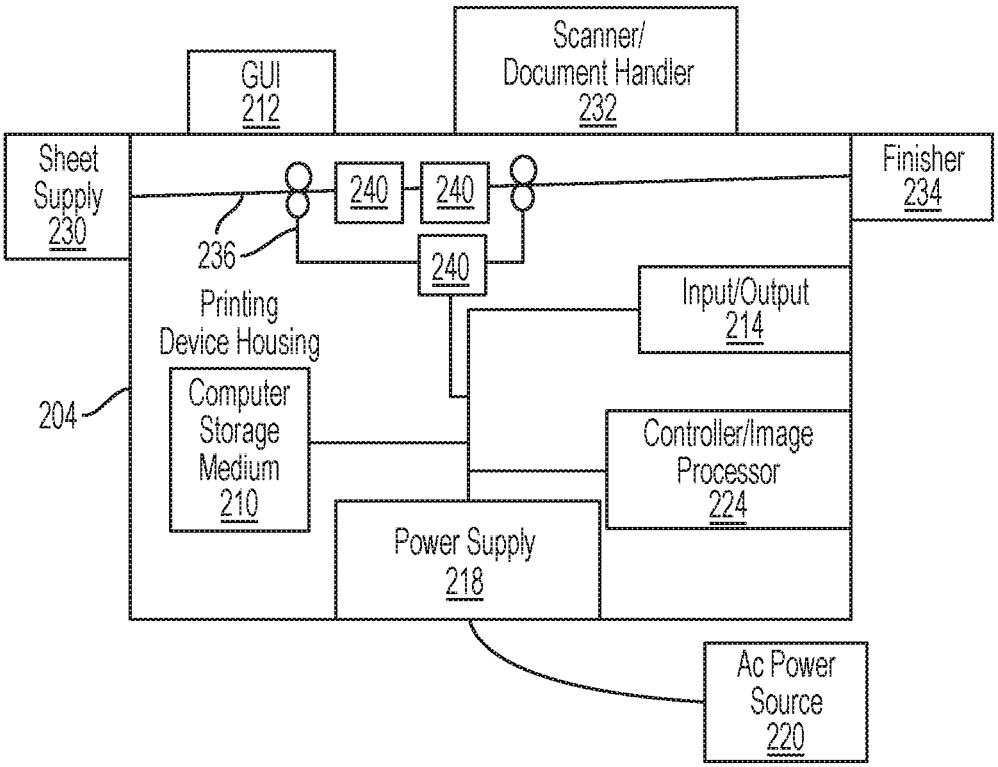
FIGS. 3-6 are schematic diagram illustrating printing devices herein.

FIG. 3 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 3, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 that use marking material, and are operatively connected to a specialized image processor 224 (that is different from a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

Figure 4:
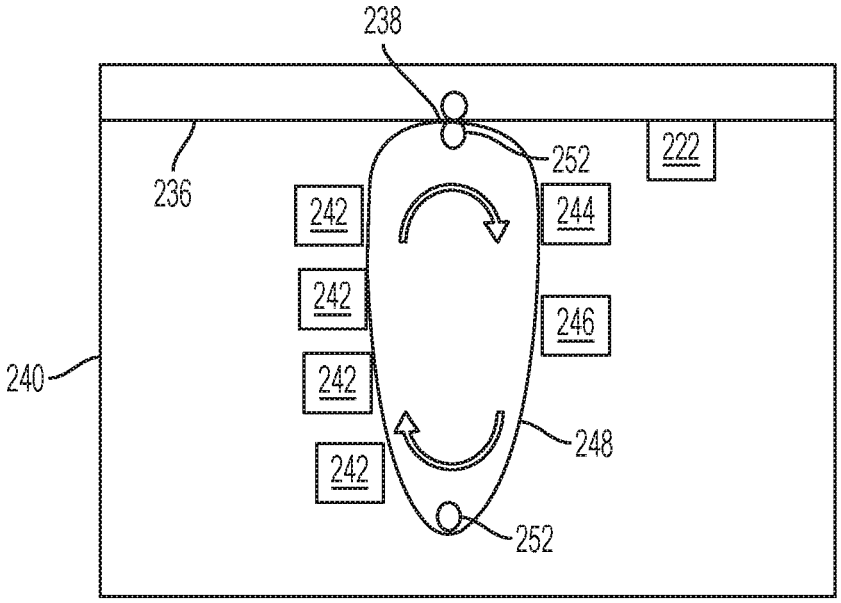
Figure 5:
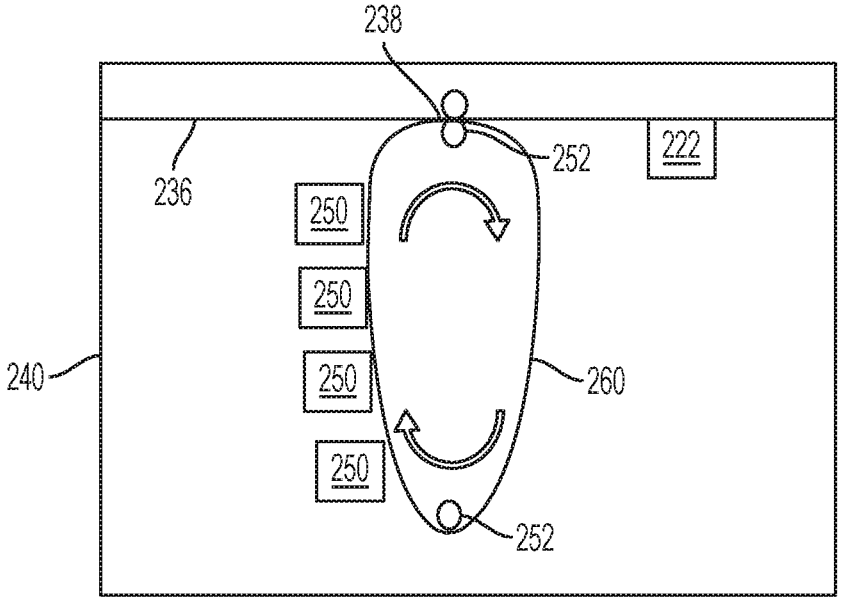

The one or more printing engines 240 are intended to illustrate any marking device that applies a marking material (toner, inks, etc.) to continuous media or sheets of media, whether currently known or developed in the future and can include, for example, devices that use a photoreceptor belt 248 (as shown in FIG. 4) or an intermediate transfer belt 260 (as shown in FIG. 5), etc.

More specifically, FIG. 4 illustrates one example of the above-mentioned printing engine(s) 240 that uses one or more (potentially different color) development stations 242 adjacent a photoreceptor belt 248 supported on rollers 252. Thus, in FIG. 4 an electronic or optical image or an image of an original document or set of documents to be reproduced may be projected or scanned onto a charged surface of the photoreceptor belt 248 using an imaging device (sometimes called a raster output scanner (ROS)) 246 to form an electrostatic latent image. Thus, the electrostatic image can be formed onto the photoreceptor belt 248 using a blanket charging station/device 244 (and item 244 can include a cleaning station or a separate cleaning station can be used) and the imaging station/device 246 (such as an optical projection device, e.g., raster output scanner). Thus, the imaging station/device 246 changes a uniform charge created on the photoreceptor belt 248 by the blanket charging station/device 244 to a patterned charge through light exposure, for example.

The photoreceptor belt 248 is driven (using, for example, driven rollers 252) to move the photoreceptor in the direction indicated by the arrows past the development stations 242, and a transfer station 238. Note that devices herein can include a single development station 242, or can include multiple development stations 242, each of which provides marking material (e.g., charged toner) that is attracted by the patterned charge on the photoreceptor belt 248. The same location on the photoreceptor belt 248 is rotated past the imaging station 246 multiple times to allow different charge patterns to be presented to different development stations 242, and thereby successively apply different patterns of different colors to the same location on the photoreceptor belt 248 to form a multi-color image of marking material (e.g., toner) which is then transferred to print media at the transfer station 238.

As is understood by those ordinarily skilled in the art, the transfer station 238 generally includes rollers and other transfer devices. Further, item 222 represents a fuser device that is generally known by those ordinarily skilled in the art to include heating devices and/or rollers that fuse or dry the marking material to permanently bond the marking material to the print media.

Thus, in the example shown in FIG. 4, which contains four different color development stations 242, the photoreceptor belt 248 is rotated through four revolutions in order to allow each of the development stations 242 to transfer a different color marking material (where each of the development stations 242 transfers marking material to the photoreceptor belt 248 during a different revolution). After all such revolutions, four different colors have been transferred to the same location of the photoreceptor belt, thereby forming a complete multi-color image on the photoreceptor belt, after which the complete multi-color image is transferred to print media, traveling along the media path 236, at the transfer station 238.

Alternatively, printing engine(s) 240 shown in FIG. 3 can utilize one or more potentially different color marking stations 250 and an intermediate transfer belt (ITB) 260 supported on rollers 252, as shown in FIG. 5. The marking stations 250 can be any form of marking station, whether currently known or developed in the future, such as individual electrostatic marking stations, individual inkjet stations, individual dry ink stations, etc. Each of the marking stations 250 transfers a pattern of marking material to the same location of the intermediate transfer belt 260 in sequence during a single belt rotation (potentially independently of a condition of the intermediate transfer belt 260) thereby, reducing the number of passes the intermediate transfer belt 260 must make before a full and complete image is transferred to the intermediate transfer belt 260.

Figure 6:
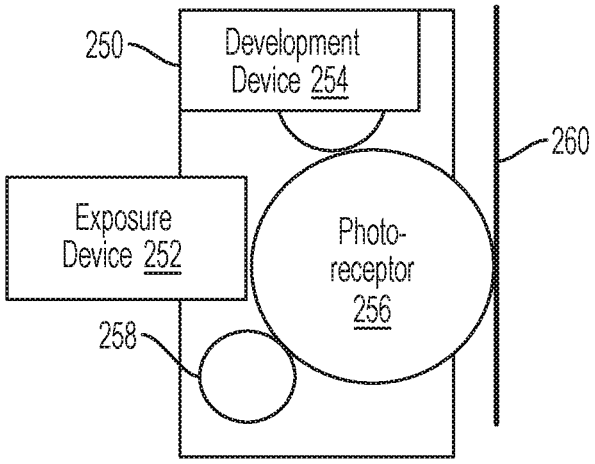

One exemplary individual electrostatic marking station 250 is shown in FIG. 6 positioned adjacent to (or potentially in contact with) intermediate transfer belt 260. Each of the individual electrostatic marking stations 250 includes its own charging station 258 that creates a uniform charge on an internal photoreceptor 256, an internal exposure device 252 that patterns the uniform charge, and an internal development device 254 that transfers marking material to the photoreceptor 256. The pattern of marking material is then transferred from the photoreceptor 256 to the intermediate transfer belt 260 and eventually from the intermediate transfer belt to the marking material at the transfer station 238.

While FIGS. 4 and 5 illustrate four marking stations 242, 250 adjacent or in contact with a rotating belt (248, 260), which is useful with systems that mark in four different colors such as, red, green, blue (RGB), and black; or cyan, magenta, yellow, and black (CMYK), as would be understood by those ordinarily skilled in the art, such devices could use a single marking station (e.g., black) or could use any number of marking stations (e.g., 2, 3, 5, 8, 11, etc.).

Thus, in printing devices herein a latent image can be developed with developing material to form a toner image corresponding to the latent image. Then, a sheet is fed from a selected paper tray supply to a sheet transport for travel to a transfer station. There, the image is transferred to a print media material, to which it may be permanently fixed by a fusing device. The print media is then transported by the sheet output transport 236 to output trays or a multi-function finishing station 234 performing different desired actions, such as stapling, hole-punching and C or Z-folding, a modular booklet maker, etc., although those ordinarily skilled in the art would understand that the finisher/output tray 234 could comprise any functional unit.

As would be understood by those ordinarily skilled in the art, the printing device 204 shown in FIG. 3 is only one example and the systems and methods herein are equally applicable to other types of printing devices that may include fewer components or more components. For example, while a limited number of printing engines and paper paths are illustrated in FIG. 3, those ordinarily skilled in the art would understand that many more paper paths and additional printing engines could be included within any printing device used with systems and methods herein.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A development device comprising:

a housing;

a magnetic roll in the housing moving marking material in the housing;

a donor roll in the housing positioned to receive the marking material from the magnetic roll;

a manifold in the housing, wherein the manifold has a manifold opening positioned to create airflow from a surface of the donor roll; and a seal over the manifold opening, wherein the seal comprises a flat rectangular component having front and back planar linear surfaces ending at edges, wherein the seal has seal openings through the front and back planar linear surfaces aligned with the manifold opening, wherein a first edge of the housing adjacent the manifold opening is a first distance from the magnetic roll and a second edge of the edges of the seal is a second distance from the magnetic roll that is less than the first distance, and wherein the second edge of the seal is positioned to form a consistent gap to the magnetic roll equal to the second distance.

2. The development device according to claim 1, wherein the manifold opening is a slot and the seal openings are round.

3. The development device according to claim 1, wherein a combined area of all the seal openings is less than an area of the manifold opening.

4. The development device according to claim 1, wherein the seal openings are periodic and are positioned at equal intervals along the flat rectangular component.

5. The development device according to claim 1, wherein the flat rectangular component has dimensions to fully cover all of the manifold opening.

6. The development device according to claim 1, wherein the manifold opening comprises a space between parallel surfaces, wherein the seal contacts the parallel surfaces to cover the manifold opening.

7. The development device according to claim 1, further comprising an airflow device drawing air through the manifold to create airflow from the surface of the donor roll.

8. A printer comprising:

a media supply;

a printing engine positioned to receive print media from the media supply, wherein the printing engine adds markings to the print media using a development device, and wherein the development device comprises:

a housing;

a magnetic roll in the housing moving marking material in the housing;

a donor roll in the housing positioned to receive the marking material from the magnetic roll;

a manifold in the housing, wherein the manifold has a manifold opening positioned to create airflow from a surface of the donor roll; and a seal over the manifold opening, wherein the seal comprises a flat rectangular component having front and back planar linear surfaces ending at edges, wherein the seal has seal openings through the front and back planar linear surfaces aligned with the manifold opening, wherein a first edge of the housing adjacent the manifold opening is a first distance from the magnetic roll and a second edge of the edges of the seal is a second distance from the magnetic roll that is less than the first distance, and wherein the second edge of the seal is positioned to form a consistent gap to the magnetic roll equal to the second distance.

9. The printer according to claim 8, wherein the manifold opening is a slot and the seal openings are round.

10. The printer according to claim 8, wherein a combined area of all the seal openings is less than an area of the manifold opening.

11. The printer according to claim 8, wherein the seal openings are periodic and are positioned at equal intervals along the flat rectangular component.

12. The printer according to claim 8, wherein the flat rectangular component has dimensions to fully cover all of the manifold opening.

13. The printer according to claim 8, wherein the manifold opening comprises a space between parallel surfaces, wherein the seal contacts the parallel surfaces to cover the manifold opening.

14. The printer according to claim 8, further comprising an airflow device drawing air through the manifold to create airflow from the surface of the donor roll.

15. A seal of a development device, the seal comprising:

a flat rectangular component having front and back planar linear surfaces ending at edges; and seal openings through the front and back planar linear surfaces, wherein the flat rectangular component covers a manifold opening in a housing, wherein the manifold opening is positioned to create airflow from a surface of a donor roll of the development device, wherein the seal openings are aligned with the manifold opening, wherein a first edge of the housing adjacent the manifold opening is a first distance from a magnetic roll of the development device, wherein and a second edge of the edges of the seal is a second distance from the magnetic roll that is less than the first distance, wherein the second edge of the seal is positioned to form a consistent gap to the magnetic roll equal to the second distance, and wherein the donor roll is positioned in the development device in a position to receive the marking material from the magnetic roll.

16. The seal according to claim 15, wherein the manifold opening is a slot and the seal openings are round.

17. The seal according to claim 15, wherein a combined area of all the seal openings is less than an area of the manifold opening.

18. The seal according to claim 15, wherein the seal openings are periodic and are positioned at equal intervals along the flat rectangular component.

19. The seal according to claim 15, wherein the flat rectangular component has dimensions to fully cover all of the manifold opening.

20. The seal according to claim 15, wherein the manifold opening comprises a space between parallel surfaces, wherein the seal contacts the parallel surfaces to cover the manifold opening.

* * * * *